US012127584B2

(12) United States Patent
Tovmasyan

(10) Patent No.: US 12,127,584 B2
(45) Date of Patent: Oct. 29, 2024

1

(54) VAPORIZER ACCESSORY CASE AND KIT

(71) Applicant: Armen Tovmasyan, Valencia, CA (US)

(72) Inventor: Armen Tovmasyan, Valencia, CA (US)

( * ) Notice: Subject to any disclaimer, the term of this patent is extended or adjusted under 35 U.S.C. 154(b) by 963 days.

(21) Appl. No.: 17/115,919

(22) Filed: Dec. 9, 2020

(65) Prior Publication Data

US 2021/0186093 A1 Jun. 24, 2021

Related U.S. Application Data

(60) Provisional application No. 62/950,225, filed on Dec. 19, 2019.

(51) Int. Cl.

| | |
|---|---|
| ***A24F 15/01*** | (2020.01) |
| ***B65D 43/16*** | (2006.01) |
| ***B65D 43/22*** | (2006.01) |
| ***B65D 81/05*** | (2006.01) |

(52) U.S. Cl.

CPC ..... *A24F 15/01* (2020.01); *B65D 43/163* (2013.01); *B65D 43/22* (2013.01); *B65D 81/051* (2013.01)

(58) Field of Classification Search

CPC .... B65D 43/163; B65D 43/22; B65D 81/051; A24F 15/01; A24F 40/10; A24F 40/20; A24F 40/95

See application file for complete search history.

(56) References Cited

U.S. PATENT DOCUMENTS

| | | | | |
|---|---|---|---|---|
| 9,078,472 | B2 * | 7/2015 | Liu | A24F 40/40 |
| 9,254,005 | B2 * | 2/2016 | Liu | A24F 15/01 |
| D751,757 | S | 3/2016 | Stern | |
| 9,415,929 | B2 * | 8/2016 | Liu | A24F 15/01 |
| 10,070,667 | B2 * | 9/2018 | Lord | H03K 17/9517 |
| 10,167,134 | B2 * | 1/2019 | Zeitlin | A45C 11/00 |
| 10,435,201 | B2 * | 10/2019 | Hopps | A45C 13/007 |
| 11,547,148 | B2 * | 1/2023 | Lee | A24F 40/46 |
| 11,882,870 | B2 * | 1/2024 | Han | A24F 40/53 |
| 2002/0126864 | A1 * | 9/2002 | Dennis, III | H04R 25/00 381/328 |
| 2004/0134818 | A1 * | 7/2004 | Cunningham | B25H 3/023 206/373 |
| 2013/0146489 | A1 * | 6/2013 | Scatterday | A24F 15/01 206/256 |

(Continued)

OTHER PUBLICATIONS

KR_20160096744 w/ translation (Year: 2016).*
KR_20170137370 w/ translation (Year: 2017).*
KR_20170141446 w/ translation (Year: 2017).*

*Primary Examiner* — Marcus E Harcum
(74) *Attorney, Agent, or Firm* — Phil IP Law Inc.; Narek Zohrabyan; Karen Kirk Galoyan

(57) ABSTRACT

A vaporizer accessory case and kit is provided. The device includes a container having a base and a plurality of perimeter sidewalk defining an interior volume. A lid is removably securable to the plurality of perimeter sidewalk, such that the lid encloses the interior volume. An insert is disposed within the interior volume, wherein the insert includes a plurality of divided slots. Each of the plurality of divided slots is dimensioned to removably secure at least one vaporizer accessory therein. In some embodiments, a plurality of sanitary mouthpiece covers is further provided, the plurality of sanitary mouthpiece covers including a first open end opposite a second open end, wherein the second open end is removably securable to a vaporizer mouthpiece.

11 Claims, 3 Drawing Sheets

(56) References Cited

U.S. PATENT DOCUMENTS

| | | | | |
|---|---|---|---|---|
| 2014/0107815 | A1 | 4/2014 | LaMothe | |
| 2014/0299492 | A1* | 10/2014 | Liu | A24F 15/01 206/264 |
| 2015/0101945 | A1* | 4/2015 | Scatterday | A24F 13/14 206/268 |
| 2015/0102777 | A1 | 4/2015 | Cooper | |
| 2015/0374038 | A1* | 12/2015 | Akiyama | A61M 15/06 131/329 |
| 2016/0113323 | A1* | 4/2016 | Liu | A24F 15/01 206/268 |
| 2016/0134143 | A1 | 5/2016 | Liu | |
| 2016/0213062 | A1 | 7/2016 | Doyle | |
| 2017/0050798 | A1* | 2/2017 | Ludewig | B65D 25/04 |
| 2017/0325500 | A1* | 11/2017 | Senftleben | A24F 13/14 |
| 2017/0327291 | A1* | 11/2017 | Senftleben | B65D 13/04 |
| 2018/0296777 | A1* | 10/2018 | Terry | A61M 11/042 |
| 2019/0062018 | A1* | 2/2019 | McClellan | A61J 1/16 |
| 2020/0077699 | A1* | 3/2020 | Bagai | A24F 40/90 |
| 2020/0281264 | A1* | 9/2020 | Wright | A24F 40/60 |
| 2020/0407144 | A1* | 12/2020 | Kemp | B65D 43/163 |
| 2021/0186092 | A1* | 6/2021 | Tidwell | A24F 15/01 |
| 2021/0186094 | A1* | 6/2021 | Tidwell | B65D 85/109 |
| 2023/0180826 | A1* | 6/2023 | Murison | B67D 7/145 206/255 |

* cited by examiner

VAPORIZER ACCESSORY CASE AND KIT

CROSS REFERENCE TO RELATED APPLICATIONS

This application claims the benefit of U.S. Provisional Application No. 62/950,225 filed on Dec. 19, 2019. The above identified patent application is herein incorporated by reference in its entirety to provide continuity of disclosure.

BACKGROUND OF THE INVENTION

The present invention relates to vaporizer accessory storage cases. More particularly, the present invention pertains to a vaporizer accessory case having an insert with a plurality of divided slots for removably securing various vaporizer accessories therein, including sanitary vaporizer mouthpiece covers.

Many individuals enjoy vaping as an alternative to smoking. Vaping typically utilizes a portable heating element vaporizes a fluid that can then be inhaled through a mouthpiece. Vaping provides many benefits over smoking. Generally speaking, vaping generates a healthier inhalant that can be flavored or otherwise customized to suit an individual's preferences. Vaping can further be enjoyable as a group activity, where several people share the vaporizer. However, this can be result in hygiene issues. Particularly, failing to protect or wipe down the mouthpiece of the vaporizer between users can transmit pathogens. Furthermore, bacteria and other pathogens can propagate if the vaporizer elements are not stored properly. Leaving a vaporizer mouthpiece uncovered and in open air can result in further pathogen spread. Therefore, a device that can store vaporizer accessories, and also provide sanitary mouthpiece covers for use with multiple users to improve hygiene and prevent the spread of illness is desired.

In light of the devices disclosed in the known art, it is submitted that the present invention substantially diverges in design elements from the known art and consequently it is clear that there is a need in the art for an improvement to existing vaporizer accessory storage cases. In this regard, the instant invention substantially fulfills these needs.

SUMMARY OF THE INVENTION

In view of the foregoing disadvantages inherent in the known types of vaporizer accessory cases now present in the known a , the present invention provides a vaporizer accessory case wherein the same can be utilized for providing convenience for the user when utilizing sanitary vaporizer mouthpiece covers for sharing a vaporizer with multiple users in a safe and sanitary way.

The present system comprises a container having a base and a plurality of perimeter sidewalls extending therefrom defining an interior volume. A lid is removably securable to the plurality of perimeter sidewalk, the lid configured to enclose the interior volume. An insert is disposed within the interior volume, wherein the insert includes a plurality of divided slots therein. Each of the plurality of slots is dimensioned to removably secure at least one vaporizer accessory therein. In some embodiments, a plurality of sanitary mouthpiece covers is further provided, the plurality of sanitary mouthpiece covers including a first open end opposite a second open end, wherein the second open end is removably securable to a vaporizer mouthpiece.

In some embodiments, the lid is hingedly affixed to at least one perimeter sidewall of the plurality of perimeter sidewalk. In another embodiment, the lid comprises a lip configured to frictionally engage the plurality of perimeter sidewalk. In other embodiments, the lid further comprises a latch thereon, wherein the latch engages a receiver disposed on an exterior of at least one perimeter sidewall of the plurality of perimeter sidewalk. In yet another embodiment, the insert comprises a compressible material. In some embodiments, the compressible material comprises a foam material. In another embodiment, each of the plurality of divided slots comprise a smaller size than an associated vaporizer accessory, such that each of the plurality of divided slots frictionally engage the associated vaporizer accessory. In other embodiments, the at least one vaporizer accessory is selected from a group consisting of a sanitary mouthpiece cover, a vaporizer cartridge, a vaporizer body, and a vaporizer charging system. In yet another embodiment, the sanitary mouthpiece cover tapers radially inwardly from a second open end thereof towards a first open end thereof, such that the second open end comprises a greater diameter than the first open end. In some embodiments, the second open end is configured to form an airtight seal secured to the vaporizer mouthpiece. In another embodiment, the sanitary mouthpiece cover comprises a silicone material.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
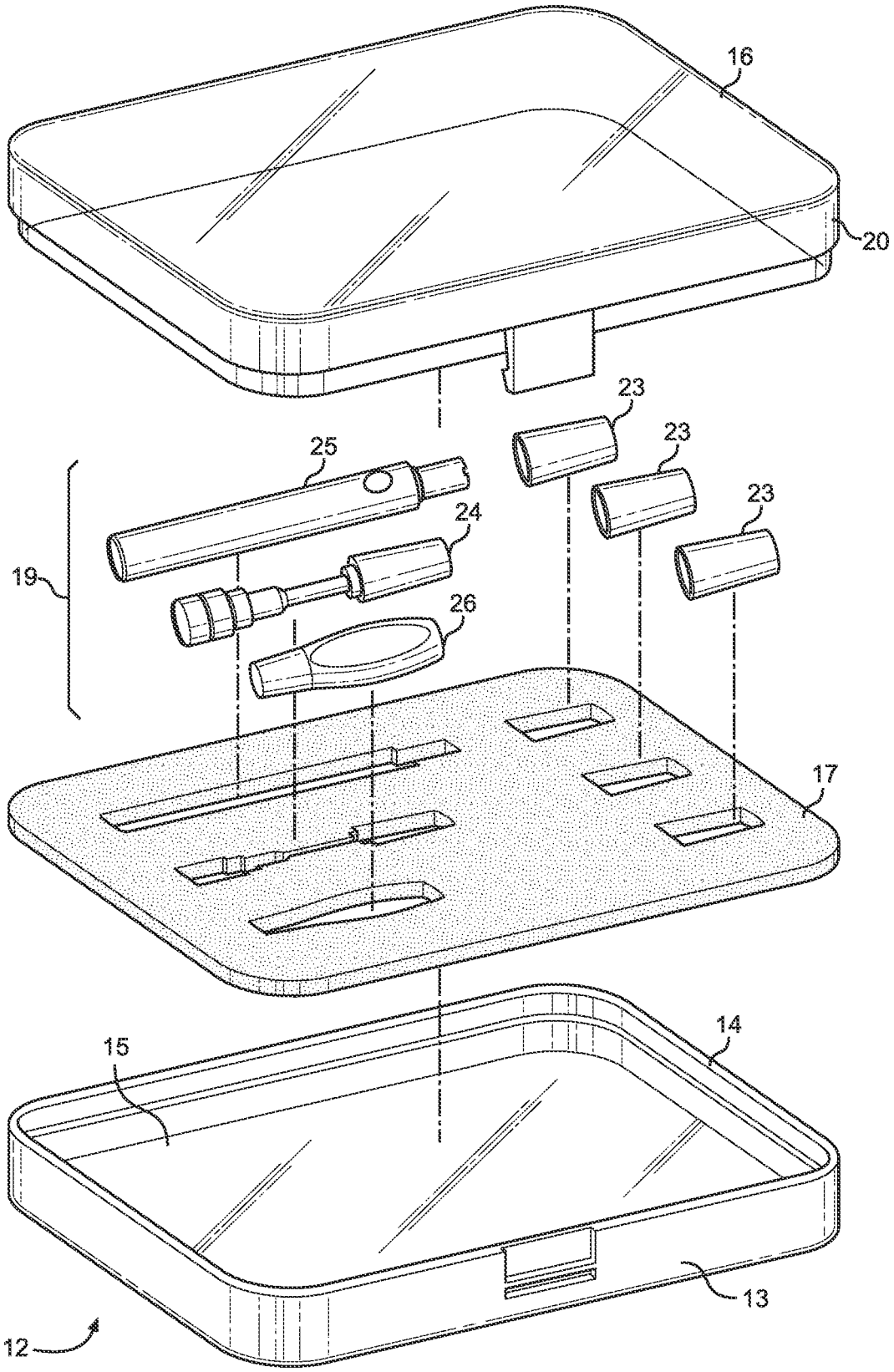
FIG. 1 shows an exploded view of an embodiment of the vaporizer accessory case and kit.

Reference is made herein to the attached drawings. Like reference numerals are used throughout the drawings to depict like or similar elements of the vaporizer accessory case and kit. The figures are intended for representative purposes only and should not be considered to be limiting in any respect.

Referring now to FIG. 1, there is shown an exploded view of an embodiment of the vaporizer accessory case and kit. The vaporizer accessory kit 11 comprises a container 12 having a base 13 having a plurality of perimeter sidewalk 14 extending therefrom defining an interior volume 15. A lid 16 is removably securable to the plurality of perimeter sidewalks 14, wherein the lid 16 is configured to enclose the interior volume when secured to the plurality of perimeter sidewalk 14, In the illustrated embodiment, the lid 16 further comprises a lip 20 extending from a lower side of the lid 16, wherein the lip 20 frictionally engages an interior of the plurality of perimeter sidewalk 14 when the lid 16 is secured thereto. In such embodiments, an outer surface of the lid 16 rests flush with an exterior of the plurality of perimeter sidewalk 14 when secured thereto. In this manner, the lid 16 does not catch on surrounding objects, thereby ensuring that the lid 16 remains affixed to the container 12 during transport. In the shown embodiment, the container 12 and the lid 16 each comprise a transparent material such that the user can readily view the interior volume 15 while the lid 16 is affixed to the container 12. Alternatively, in other embodiments, the container 12 and lid 16 comprise an opaque material.

Figure 2:
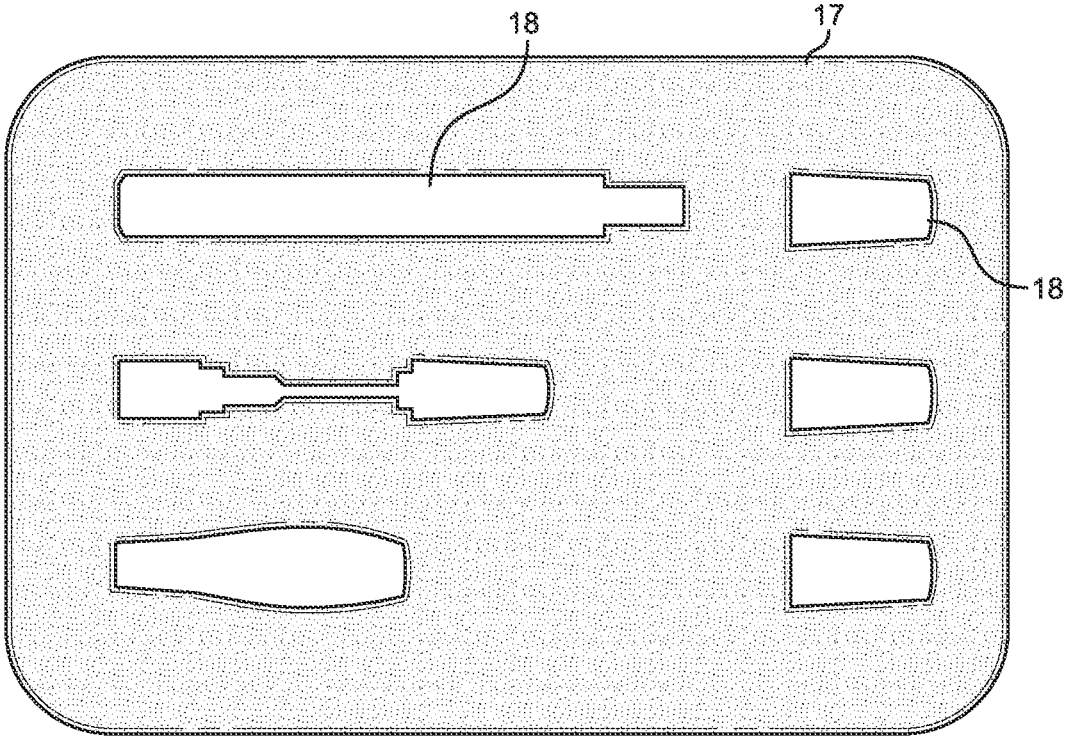
FIG. 2 shows a perspective view of the insert of an embodiment of the vaporizer accessory case and kit.

An insert 17 is disposed within the interior volume 15 of the container 12. In some embodiments, the insert 17 is removably securable within the interior volume 15, such that multiple inserts 17 can be interchanged to operate with different vaporizers and associated accessories. The insert 17 includes a plurality of divided slots (as shown in FIG. 2, 18) configured to removably receive a plurality of vaporizer accessories 19. In some embodiments, the insert 17 comprises a compressible material, thereby allowing the insert 17 to deform to retain various vaporizer accessories therein, such that the vaporizer accessory kit 11 can be utilized with a variety of vaporizer models. In some embodiments, the compressible material comprises a foam material, thereby providing shock absorbing properties consistent with maintaining the security of the plurality of vaporizer accessories 19 therein.

In the illustrated embodiment, the plurality of vaporizer accessories 19 consists of a plurality of sanitary mouthpiece covers 23, a vaporizer cartridge 24, a vaporizer body 25, and a vaporizer charging system 26. The vaporizer cartridge 24 comprises an interior reservoir containing a vaporizer fluid configured to be heated to transition to a vapor for inhalation through a mouthpiece disposed on the vaporizer cartridge 24. The vaporizer body 25 further includes a power source and a heating element therein, wherein the heating element is configured to heat the vaporizer fluid to a temperature sufficient to vaporize the fluid for inhalation when the heating element is activated. In the shown embodiment, the vaporizer body 25 is removably securable to the vaporizer cartridge 24. The vaporizer charging system 26 is configured to operably connect to the vaporizer body 25 and the power source therein, such that the power source is rechargeable thereby. In the illustrated embodiment, the vaporizer charging system 26 comprises a USB connector, however, in alternate embodiments, alternate charging means are contemplated.

In embodiments of the vaporizer accessory kit 11, the plurality of sanitary mouthpiece covers 23 are included, whereas, in alternate embodiments, the container 12 and insert 17 are provided for use with existing vaporizers and accessories. The plurality of sanitary mouthpiece covers 23 are configured to prevent the transfer of pathogens to the vaporizer mouthpiece, such that the user can readily remove the sanitary mouthpiece cover 23 from the vaporizer mouthpiece to share the vaporizer with another user. In this manner, the vaporizer accessory kit 11 provides a portable and convenient means for transporting and safely sharing a vaporizer with multiple users.

Referring now to FIG. 2, there is shown a perspective view of the insert of an embodiment of the vaporizer accessory case and kit. In the shown embodiment, the insert 17 comprises a plurality of divided slots 18 disposed across the surface thereof, wherein the plurality of divided slots 18 are each dimensioned to receive a vaporizer accessory of the plurality of vaporizer accessories therein. The plurality of divided slots 18 are contemplated to be dimensioned to include a smaller cross-section than the associated vaporizer accessory, such that the vaporizer accessory is configured to be frictionally engaged by the associated divided slot 18. In this manner, the plurality of divided slots 18 are configured to retain the plurality of vaporizer accessories therein within a close tolerance. In the illustrated embodiment, each divided slot of the plurality of divided slots 18 are dimensioned to contour to the shape of each vaporizer accessory of the plurality of vaporizer accessories. In this manner, the insert 17 can be designed to function with a particular model of vaporizer.

Figure 3:
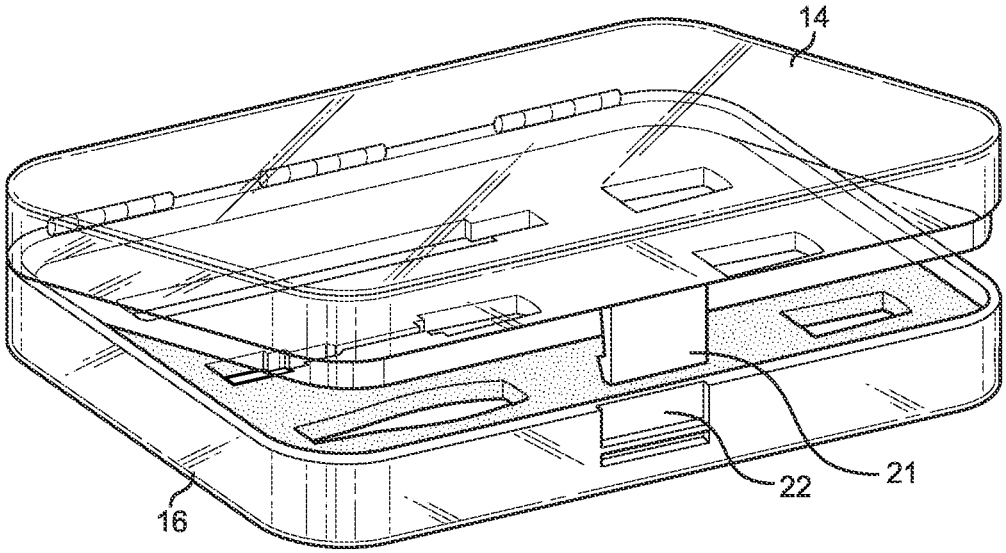
FIG. 3 shows a close-up view of the container of an embodiment of the vaporizer accessory case and kit.

Referring now to FIG. 3, there is shown a close-up view of the container of an embodiment of the vaporizer accessory case and kit. In the illustrated embodiment, the lid 16 is hingedly affixed to one of the plurality of sidewalls 14, wherein the lid 16 is selectively movable between an open position and a closed position. In the shown embodiment, the lid 16 further comprises a latch 21 thereon, wherein the latch 21 is configured to frictionally engage a receiver 22 disposed on one of the plurality of sidewalls 14. Once engaged within the receiver 22, the latch 21 is configured to prevent the lid 16 from the moving from the closed position to the open position. In the shown embodiment, the latch 21 and the receiver 22 are disposed opposite the hinge. In the illustrated embodiment, the latch 21 includes a substantially triangular protrusion having an angled upper platform configured to engage within the receiver 22 such that upward pressure placed upon the lid 16 forces the protrusion from the receiver 22 to disengage the latch 21.

Figures 4, 4A:
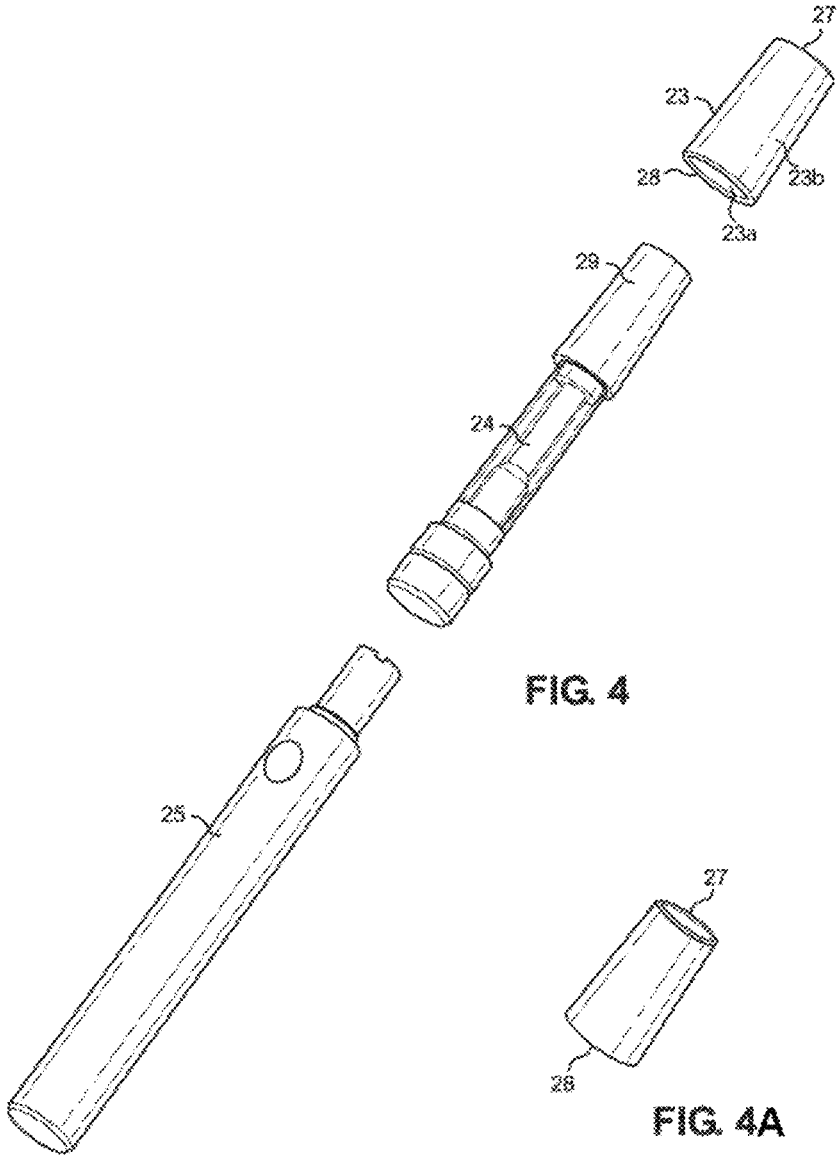
FIG. 4 shows an exploded view of the sanitary mouthpiece cover of an embodiment of the vaporizer accessory kit in use.
FIG. 4A shows a perspective view of a sanitary mouthpiece cover.

Referring now to FIG. 4, there is shown an exploded view of the sanitary mouthpiece cover of an embodiment of the vaporizer accessory kit in use. In the illustrated embodiment, the sanitary mouthpiece cover 23 comprises a first open end 27 opposite a second open end 28, wherein the sanitary mouthpiece cover 23 tapers radially inward from the second open end 28 to the first open end 27, such that the second open end 28 comprises a larger diameter than that of the first open end 27. Furthermore, the sanitary mouthpiece cover 23 comprises an inner surface 23*a* and an outer surface 23*b*, wherein the outer surface 23*b* and the inner surface 23*a* are substantially parallel to each other. The outer surface 23*b* of the sanitary mouthpiece cover 23 tapers radially from the second open end 28 towards the first open end 27, while the inner surface 23*a* of the sanitary mouthpiece cover 23 also tapers radially from the second open end 28 towards the first open end 27, maintaining a substantially constant thickness between the outer surface 23*b* and the inner surface 23*a* throughout the length of the sanitary mouthpiece cover 23. In some embodiments, the sanitary mouthpiece cover 23 comprises a silicone material, such that the durability and ease of cleaning is maximized. The second open end 28 is configured to removably secure to a mouthpiece 29 of the vaporizer cartridge 24, such that an airtight seal is formed there between. In this manner, the suction applied to the first open end 27 during use is fully transferred to the mouthpiece 29, such that usage of the sanitary mouthpiece cover 23 mimics the usage of the vaporizer mouthpiece 29 in typical operation. In one use, the user can retrieve the container from a storage location and assemble the vaporizer by retrieving the plurality of vaporizer accessories from the interior volume. Once the vaporizer body 25 is affixed to the vaporizer cartridge 24, the user can apply a sanitary mouthpiece cover 23 to the mouthpiece 29 of the vaporizer cartridge 24. In some uses, a sanitary mouthpiece cover 23 is associated with a particular user, such that multiple users each have a personal sanitary mouthpiece cover 23. In this manner, the user can utilize the vaporizer by inhaling through the sanitary mouthpiece cover 23, while minimizing the transmission of pathogens between multiple users.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vaporizer accessory kit, comprising:

a container having a base and a plurality of perimeter sidewalls extending therefrom defining an interior volume;

a lid removably securable to the plurality of perimeter sidewalls, the lid configured to enclose the interior volume;

an insert disposed within the interior volume;

wherein the insert includes a plurality of divided slots therein;

wherein at least one of the plurality of divided slots is dimensioned to removably secure at least one sanitary mouthpiece cover therein;

wherein at least one of the plurality of divided slots is dimensioned to removable secure at least one vaporizer accessory;

at least one sanitary mouthpiece cover comprising a first open end opposite a second open end, wherein the second open end is configured to removably secure to a vaporizer mouthpiece;

wherein an inner surface of the at least one sanitary mouthpiece cover tapers radially inwardly from a second open end thereof towards a first open end thereof, such that the second open end comprises a greater diameter than the first open end; and wherein an outer surface of the at least one sanitary mouthpiece cover tapers radially from the second open end towards the first open end, following the same tapering profile as an inner surface.

2. The vaporizer accessory kit of claim 1, wherein the lid is hingedly affixed to at least one perimeter sidewall of the plurality of perimeter sidewalls.

3. The vaporizer accessory kit of claim 1, wherein the lid comprises a lip configured to frictionally engage an interior of the plurality of perimeter sidewalls.

4. The vaporizer accessory kit of claim 1, wherein the lid further comprises a latch thereon, wherein the latch engages a receiver disposed on an exterior of at least one perimeter sidewall of the plurality of perimeter sidewalls.

5. The vaporizer accessory kit of claim 1, wherein the insert comprises a compressible material.

6. The vaporizer accessory kit of claim 5, wherein the compressible material comprises a foam material.

7. The vaporizer accessory kit of claim 5, wherein each of the plurality of divided slots comprise a smaller size than an associated vaporizer accessory, such that each of the plurality of divided slots frictionally engage the associated vaporizer accessory.

8. The vaporizer accessory kit of claim 1, further comprising at least one vaporizer accessory, wherein at least one of the plurality of divided slots is dimensioned to removably secure the at least one vaporizer accessory therein.

9. The vaporizer accessory kit of claim 8, wherein the at least one vaporizer accessory is selected from a group consisting of: a sanitary mouthpiece cover, a vaporizer cartridge, a vaporizer body, and a vaporizer charging system.

10. The vaporizer accessory kit of claim 1, wherein the second open end is configured to form an airtight seal when secured to the vaporizer mouthpiece.

11. The vaporizer accessory kit of claim 1, wherein the sanitary mouthpiece cover comprises a silicone material.

* * * * *